US005527030A

United States Patent [19]

Kimura et al.

[11] Patent Number: 5,527,030

[45] Date of Patent: Jun. 18, 1996

[54] RECORDING PAPER SORTING AND DISCHARGING DEVICE

[75] Inventors: Kenichi Kimura; Toshiaki Ohno; Satoshi Kaneta, all of Suwa, Japan

[73] Assignee: Seiko Epson Corporation, Tokyo, Japan

[21] Appl. No.: 416,258

[22] Filed: Apr. 4, 1995

Related U.S. Application Data

[62] Division of Ser. No. 119,013, Sep. 9, 1993, Pat. No. 5,427, 367.

[30] Foreign Application Priority Data

| | | | |
|---|---|---|---|
| Sep. 9, 1992 | [JP] | Japan | 4-063234 |
| Sep. 11, 1992 | [JP] | Japan | 4-070197 |
| Sep. 11, 1992 | [JP] | Japan | 4-070198 |

[51] Int. Cl.[6] ..... B65H 29/20

[52] U.S. Cl. ..... 271/185

[58] Field of Search ..... 271/184, 185, 271/207, 285, 286, 298, 314, 176

[56] References Cited

U.S. PATENT DOCUMENTS

| | | | |
|---|---|---|---|
| 3,412,676 | 11/1968 | Tonkin et al. . | |
| 4,188,025 | 2/1980 | Gusfafson et al. | 271/314 |
| 4,681,312 | 7/1987 | Harvey | 271/286 X |
| 4,861,221 | 8/1989 | Fuchs | 414/791.2 |
| 5,088,721 | 2/1992 | Suzuki et al. | 271/293 |

FOREIGN PATENT DOCUMENTS

| | | | |
|---|---|---|---|
| 4009416 | 11/1990 | Germany . | |
| 2169 | 7/1965 | Japan . | |
| 151455 | 11/1980 | Japan . | |
| 59-177237 | 10/1984 | Japan . | |
| 60-19645 | 1/1985 | Japan . | |
| 0211267 | 9/1987 | Japan | 271/207 |
| 63-295369 | 12/1988 | Japan . | |
| 1-133861 | 5/1989 | Japan . | |
| 1-317957 | 12/1989 | Japan . | |
| 0117560 | 5/1990 | Japan | 271/207 |

*Primary Examiner*—William E. Terrell
*Assistant Examiner*—Tamara Kelly
*Attorney, Agent, or Firm*—Stroock & Stroock & Lavan

[57] ABSTRACT

A recording paper sorting and discharging device designed to improve the construction of copiers, printers, or the like, in sorting, separating and discharging paper in which the ends of one side of a pair of paper discharging roller shafts are shifted in a direction essentially parallel to a recording paper discharging direction while the other ends of the shafts remain stationary. The device includes a paper discharge section for discharging a recording paper in a direction essentially orthogonal to the discharge section or at an angle with respect to the discharge section, and a paper discharging tray for receiving the recording paper discharged from the discharged section. The paper discharging tray includes a first edge portion over which a section of the recording paper discharged in the orthogonal direction is projected and a second edge portion over which a section of a recording paper discharged at an angle with respect to the orthogonal discharge direction is projected. The device may also include support surfaces for supporting the rear edge of the recording paper discharged orthogonal to or at an angle with respect to the discharged section.

15 Claims, 12 Drawing Sheets

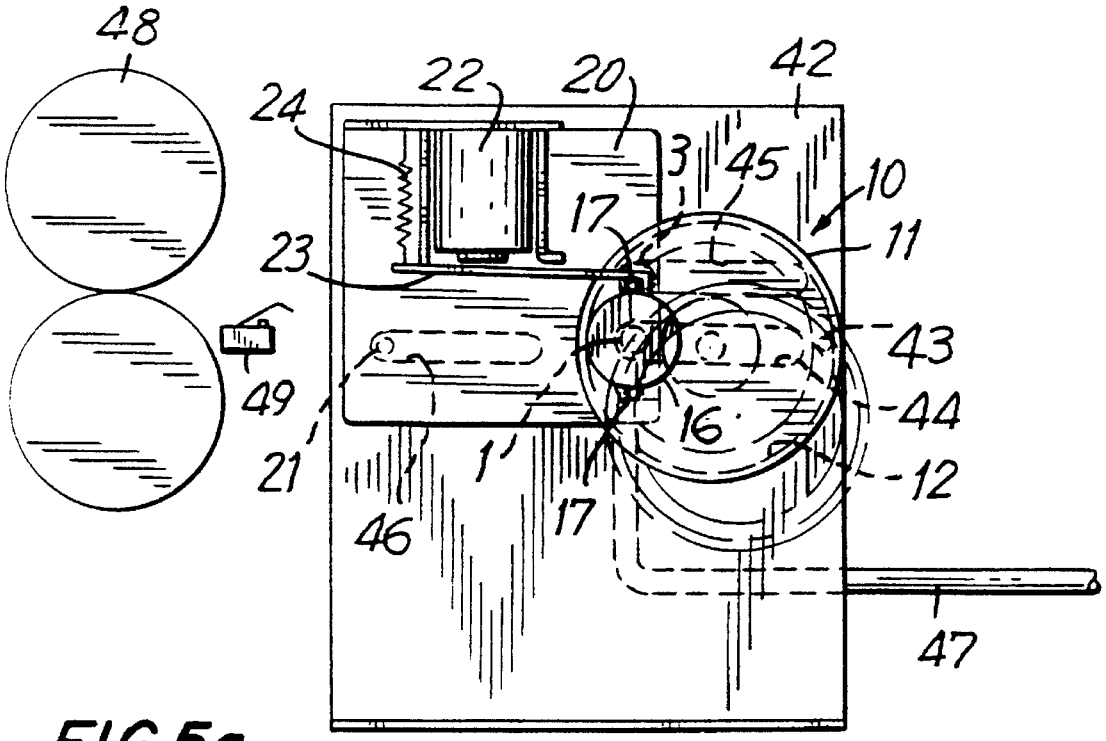
FIG.5a
FIG.5b
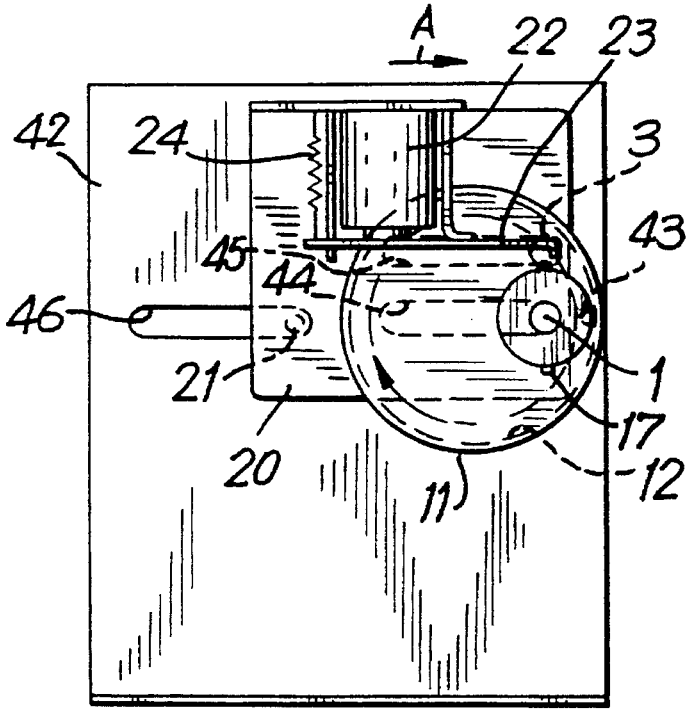

RECORDING PAPER SORTING AND DISCHARGING DEVICE

This is a divisional application of application Ser. No. 08/119,0113, filed on Sep. 9, 1993, now U.S. Pat. No. 5,427,367.

BACKGROUND OF THE INVENTION

The present invention relates generally to a recording paper sorting and discharging device for use in a printer, a copying machine or the like, and, in particular, to a recording paper sorting and discharging device which allows for easy sorting without damage to the recording paper.

Generally, with the widespread networking of computers, it is now desired to connect two or more personal computers to a common printer so that there can be a cost savings in less required printers. However, the need arises to be able to classify, sort and/or separate the recording paper on which the different information from the different computers has been printed.

In order to sort the paper, copying machines, and the like, generally use a mechanism known as a sorter. However, a sorter of this type is complicated and large, requiring a large area within the machine which ultimately results in a larger overall machine. On the other hand, printing machines generally use a simple separation mechanism known as a jogger mechanism in order to sort the paper.

Japanese Patent Publication No. 55-151455 of Showa discloses a jogger mechanism used as a paper discharging device of a copying machine. In this jogger mechanism, a brake shoe is pushed against one of two paper discharging rollers in response to a sorting signal to thereby forcibly .stop that discharging roller. The rollers are axially spaced from each other. This causes the recording paper between the rollers to swing in one direction, with the stopped paper discharging roller acting as a fulcrum, to set that piece of recording paper at a different angle relative to the other recording paper before it is discharged and sorted. Also, Japanese Patent Publication No. 55-151455 of Showa describes a technique described in Japanese Patent Publication No. 44-2169 of Showa in which, at the time of completion of a series of copying operations from the same manuscript, a shaft with a paper receiving tray mounted thereto is rotated to pile up two or more sheets; of copying paper at a new angle.

According to Japanese Patent Publication No. 55-151455 of Showa, Japanese Patent Publication No. 44-2169 of Showa has a device adapted to swing a paper receiving tray right and left.. The jogger mechanism disclosed in Japanese Patent Publication No. 55-151455 of Showa does not require any external structures to be displaced thus eliminating the possibility that the external structure can be abutted against other parts or structures which can damage or break same.

However, the device disclosed in Japanese Patent Publication No. 55-151455 of Showa still has the problem that, because the paper discharging roller is forcibly stopped by means of a brake shoe, when the recording paper is discharged at an angle, the recording paper is damaged because wrinkles are produced in the corners of the recording paper.

Accordingly, it is desired to provide an improve sorting and discharging device which will sort and discharge recording paper without damaging the paper.

SUMMARY OF THE INVENTION

Generally speaking, in accordance with the present invention, a recording paper sorting and discharging device is provided including first and second frames, a first discharging roller shaft having a first and a second end, the first discharging roller shaft being rotatably supported by the first and second ends between the first and second frames, a second discharging roller shaft having a first and a second end, the second discharging roller shaft being rotatably supported by the first and second ends between the first and second frames, a first paper discharging roller rotatably mounted on the first discharging roller shaft, a second paper discharging roller rotatably mounted on the second discharging roller shaft, and wherein the first paper discharging roller is permitted to contact the second paper discharging roller, shifting means for shifting the first end of the first and second discharging roller shafts in a direction essentially parallel to a paper discharging direction and separating means for displacing the first paper discharging roller shaft from a first predetermined position to a second predetermined position and thereafter permitting the first: paper discharging roller shaft to return to the first predetermined position.

Also, according to the invention, there is provided a further recording paper sorting and discharging device which includes a first and second frame, a first discharging roller shaft having two ends and rotatably supported at the two ends between the first and second frames, a first drive roller fixed to a first discharging roller shaft, a first driven roller rotatably mounted to a second discharging roller shaft, a second driven roller rotatably mounted to the first discharging roller shaft, the second driven roller being permitted to contact and rotate with the first drive roller, a second drive roller fixed to the second discharging roller shaft, the second drive roller being permitted to contact and rotate with the first driven roller to transmit rotation to the first driven roller, drive means for rotationally driving the first and second discharging roller shafts and cut-off means for cutting off the rotational drive force to at least one of the first and second discharging roller shafts.

Further, according to the invention, there is provided a still further recording paper sorting and discharging device which includes a discharge section for discharging a recording paper in a direction orthogonal to the discharge section or at an angle with respect to the discharge section, a paper discharging tray for receiving the recording paper discharged out from the discharge section, the paper discharging tray including a first edge portion over which a section of the recording paper discharged in the orthogonal direction is projected and a second edge portion over which a section of the recording paper discharged at an angle with respect to the orthogonal discharge direction is projected.

Accordingly, it is an object of the present invention to provide an improved paper sorting and discharging device.

Another object of the present invention is to provide a paper sorting and discharging device having a construction that will occupy a small space for installation.

Still another object of the present invention is to provide a paper sorting and discharging device which is able to sort recording paper smoothly without applying an unreasonable force onto the recording paper.

A further object of the present invention is to provide a paper sorting and discharging device which is able to sort recording paper without damaging the paper.

Yet another object of the present invention is to provide a paper sorting and discharging device which allows a user to take out the sorted recording paper easily.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5(*a*) and (*b*) are respectively side elevational views of the device in accordance with a first embodiment of the invention, explaining the operation thereof;

DETAILED DESCRIPTION OF THE PREFERRED EMBODIMENTS

The detailed description of the preferred embodiments will be given hereinbelow in which the present sorting and discharging device is applied to a printer. However, it is understood that this is by way of example and not by way of limitation. The disclosure hereinbelow is equally applicable to a copying machine or the like.

Figure 1:
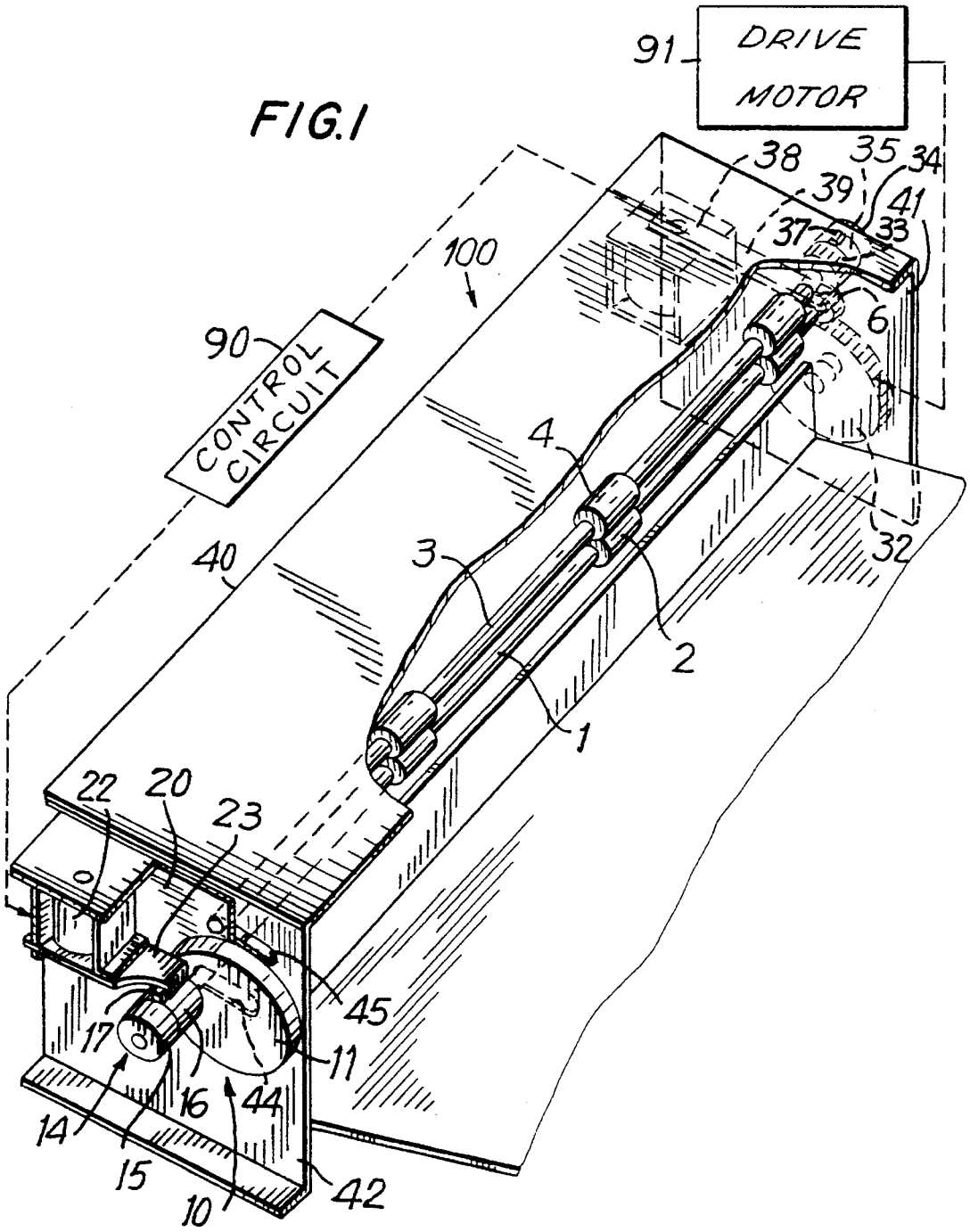
FIG. 1 is a perspective view of a recording paper sorting and discharging device viewed from the top and back side thereof, in accordance with a first embodiment of the invention.
Figure 2:
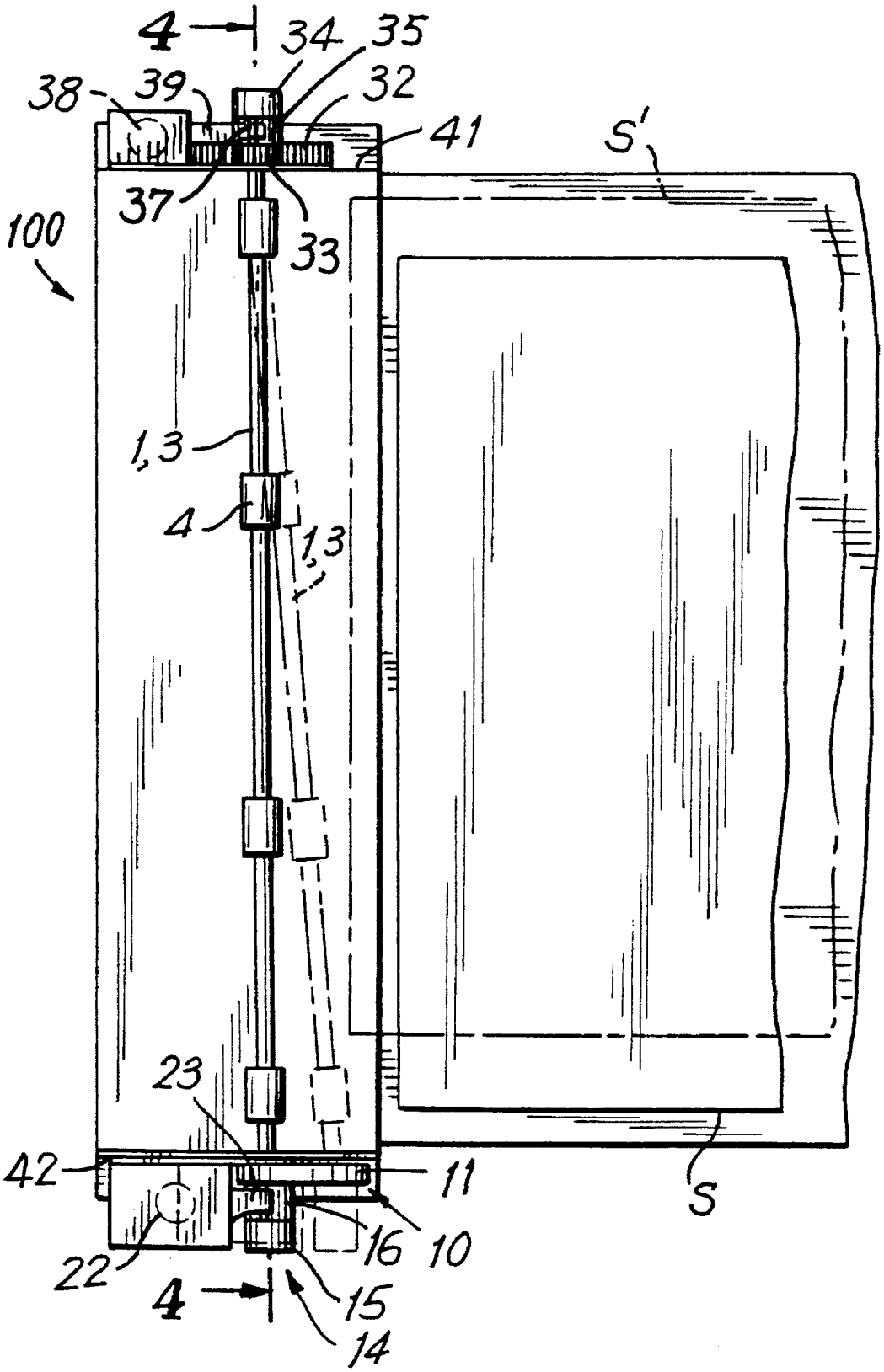
FIG. 2 is a top plan view of the recording paper sorting and discharging device in accordance with the first embodiment, explaining the operation thereof.

Reference is first made to FIG. 1 which depicts a printer main body generally indicated at 100, constructed in accordance with a first embodiment of the present invention. A paper discharging roller shaft 1 is disposed on a drive side, and a paper discharging roller shaft 3 is disposed on a driven side. Paper discharging rollers 2 and 4 are fixed to paper discharging roller shafts 1 and 3, respectively. Paper discharging rollers 2 and 4 contact each other and roll to thereby discharge the recording paper. As shown in FIG. 2, when a recording paper S' to be sorted is delivered to paper discharging roller shafts 1 and 3, paper discharging roller shafts 1 and 3 can shift obliquely with respect to a paper discharging direction as shown by the chain lines. Also, rollers 2 and 4 can be separated from and pressed against each other (which will be described later), so that recording paper S' can shift laterally and in parallel to other recording paper S and can be discharged out.

One end of each of paper discharging roller shafts 1 and 3 are rotatably journaled to a right side plate (that is, a right frame) 41 (as viewed in FIG. 1) formed integrally with a printer main body frame 40 by being bent with respect thereto, while the other end of each of paper discharging roller shafts 1 and 3 are respectively mounted through a shaft support plate 20 (FIG. 3) to a left side plate (a left frame) 42 (as viewed in FIG. 1) of printer main body frame 40 in such a manner that they are respectively rotatable and movable in the paper discharging direction.

Figure 3:
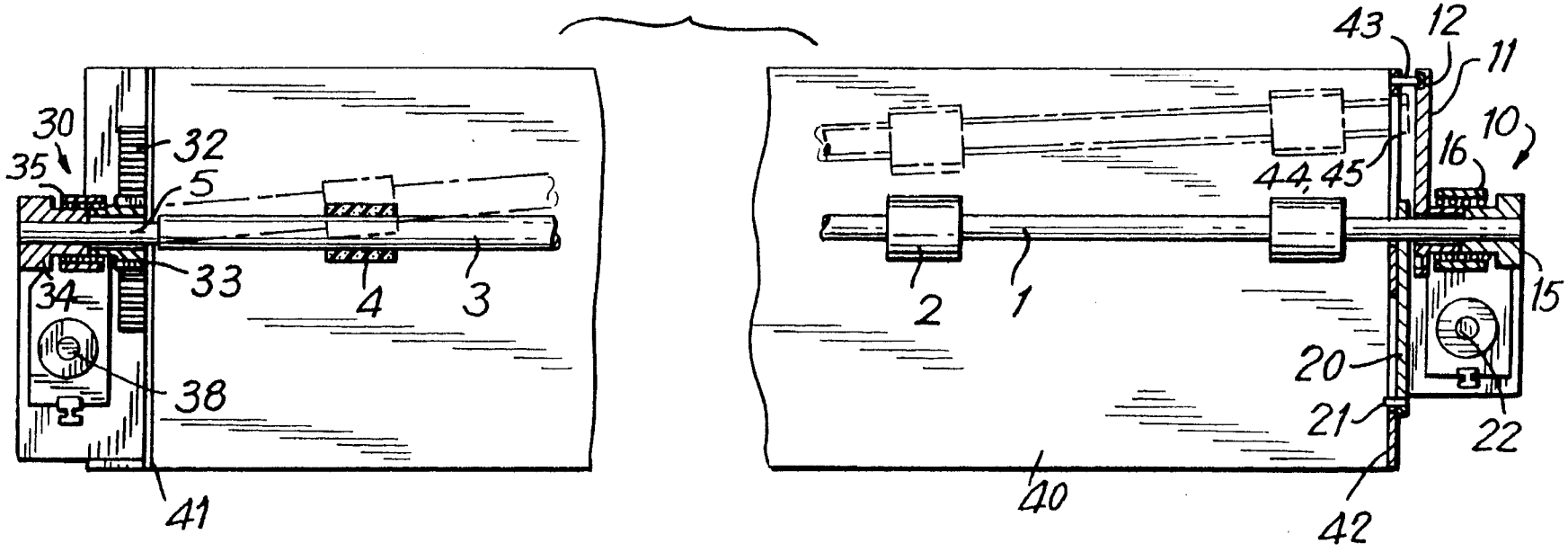
FIG. 3 is a fragmentary cross-sectional view, taken along lines 3—3 of FIG. 4.
Figure 4:
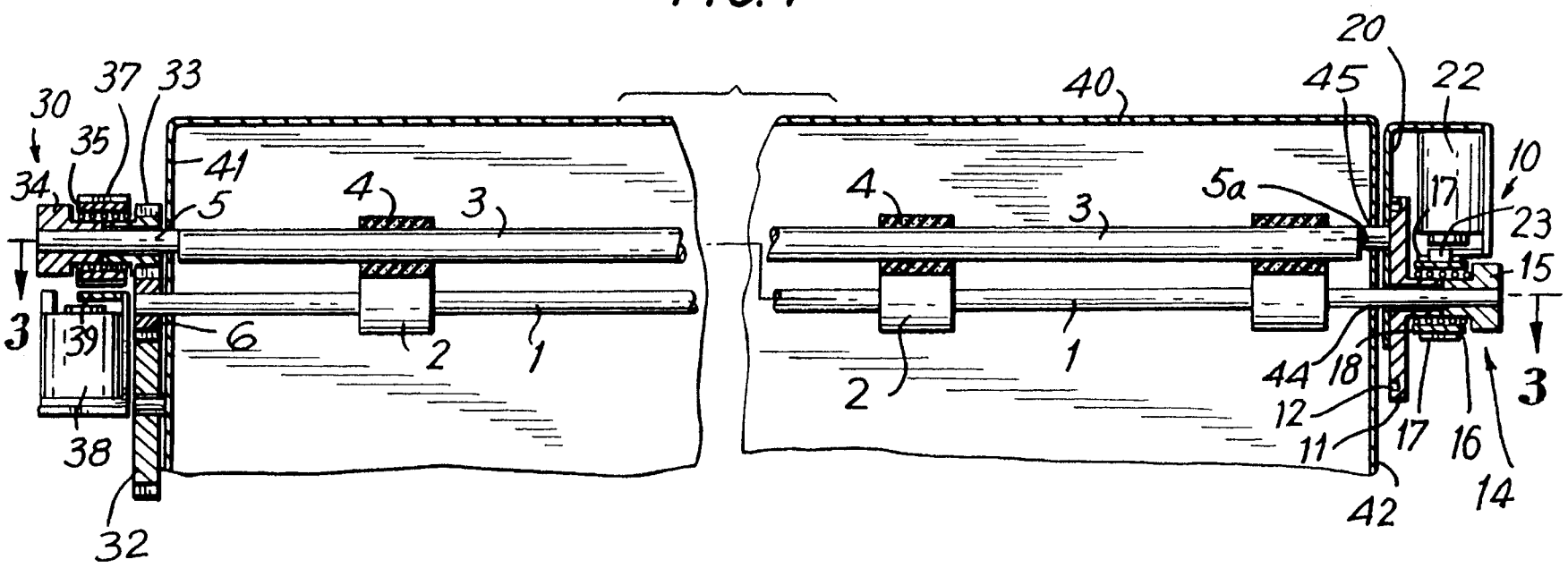
FIG. 4 is an enlarged fragmentary cross-sectional view, taken along lines 4—4 of FIG. 2.

As shown in FIGS. 3, 4 and 5, a roller shaft moving mechanism is generally indicated at 10. Roller shaft moving mechanism 10 angles and shifts in the paper discharging direction the pair of paper discharging roller shafts 1 and 3, while maintaining the shafts essentially parallel to the surface of the recording paper. The ends of paper discharge roller shafts 1 and 3 mounted to right side plate 41 act as the fulcrums for the angular shifting of the paper discharging roller shafts. An annular groove 12 (FIGS. 5*a* and 5*b*) is provided on the inner surface side of an eccentric cam 11 forming a part of roller shaft mechanism 10. A guide pin 43 is affixed in left frame 42 and rides in annular groove 12. The displaceable shaft ends of paper discharging roller shafts 1 and 3 are journaled to shaft support plate 20 for displacement therewith. The roller shaft moving mechanism 10 rotatably connects drive-side paper discharging roller shaft 1 with the eccentric position of eccentric cam 11 to thereby move laterally. Elongated slots 44 and 45 are respectively formed in left frame 42 so as to extend essentially in the paper discharging direction. Slots 44 and 45 are dimensioned to permit one discharging roller shafts 1 and 3 to ride in each slot to permit the shifting of the shafts 1 and 3.

Eccentric cam 11 is constructed and arranged to receive a rotational drive force from drive-side paper discharging roller shaft 1 through a spring clutch generally indicated at 14, which includes a bushing 15 fixed to the shaft end of drive-side paper discharging roller shaft 1 and a coil spring 18 fixed at the end thereof to the boss portion of bushing 15 and to the inner peripheral surface of a sleeve 16. Specifically, the shaft 1 is coupled to the eccentric cam 11 when the restriction of sleeve 16 is removed.

Referring to FIGS. 5*a* and 5*b*, shaft support plate 20, which supports the end portions of the pair of paper discharging roller shafts 1 and 3, is mounted so that it is restricted by a pin 21 mounted on plate 20 and inserted through a guide slot 46 formed in left side plate 42. Shaft support plate 20 can slide from one side to the other side in the paper discharging direction by the rotational movement of eccentric cam 11. Thus, shaft support plate 20 is prevented from displacement in the direction orthogonal to the discharge direction by pin 21 in guide slot 46 and paper discharging roller shafts 1 and 3 in slots 44 and 45. Further, shaft support plate 20 has a roller shaft inclining solenoid 22 mounted thereon which operates spring clutch 14. Engagement claw 23 is normally in engagement with a projection 17 on sleeve 16 by means of the action of spring 24. Solenoid 22 is constructed and arranged so that it attracts engagement claw 23 to thereby remove the engagement between claw 23 and projection 17, so that spring clutch 14 can transmit the drive force of drive-side paper discharging roller shaft 1 to eccentric cam 11.

Furthermore, FIG. 4 shows driven-side paper discharging roller shaft 3 rotatably supported on two side frames 41 and 42 by means of eccentric shafts 5, 5*a* respectively provided at the two ends of shaft 3. Paper discharging roller 4 is rotatably mounted to driven-side paper discharging roller shaft 3. By rotating driven-side paper discharging roller shaft 3, paper discharging roller 4 can be separated away from or pressed against paper discharging roller 2.

Figure 6:
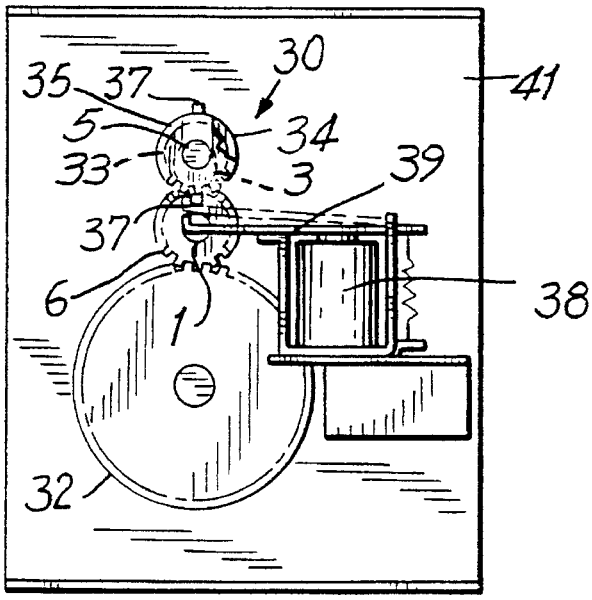
FIG. 6 is a side elevational view of the device in accordance with the first embodiment.

As shown in FIGS. 3, 4 and 6, a roller shaft shifting mechanism, generally indicated at 30, causes driven-side paper discharging roller shaft 3 to separate away from or advance towards drive-side paper discharging roller shaft 1. In mechanism 30, a pinion 33 rotatably mounted on eccentric shaft 5 of driven-side paper discharging roller shaft 3 is operatively coupled with a drive gear 32 (operatively coupled to drive motor 91 shown schematically in FIG. 1) through a pinion 6 which is fixed to the end portion of drive-side paper discharging roller shaft 1. A spring clutch 35 (FIGS. 3 and 4) is interposed between a bushing 34 and pinion 33, pinion 33 being rotatable relative to eccentric shaft 5, and bushing 34 being fixed to the end portion of eccentric shaft 5. By this construction, the rotational drive force of drive gear 32 can be selectively transmitted to the driven-side paper discharging roller shaft 3. A roller shifting solenoid 38 is mounted to right frame 41. Spring clutch 35 is mounted on eccentric shaft 5. Solenoid 38 functions to operate or restrict the operation of spring clutch 35. Solenoid 38, similar to solenoid 22, is constructed and arranged to operate an engagement claw 39 engageable with two projections 37 respectively provided on opposed surfaces of a sleeve 36 (FIG. 4) of spring clutch 35, so that driven-side paper discharging roller shaft 3 can be selectively rotated by 180°.

FIG. 5*a* depicts a paper discharging tray 47 disposed downstream of the paper discharging roller shafts 1 and 3, a fixing roller 48 which is disposed upstream of the paper discharging roller shafts 1 and 3, and a sensor 49 which is used to detect the rear end of the recording paper.

Next, description will be given below of the operation of the device in accordance with the above-mentioned embodiment.

Normally, the present device holds the pair of paper discharging roller shafts 1 and 3 in a position shown in FIG. 2 by the solid lines. That is, shafts 1 and 3 are positioned and held in a direction essentially perpendicular to the discharging direction of the recording paper, and paper discharging rollers 2 and 4 also remain in contact with each other.

However, as shown in FIGS. 3 and 5(*a*), roller shaft moving mechanism 10 rotates eccentric cam 11 to thereby position the pair of paper discharging roller shafts 1 and 3 at the rear end positions of elongated slots 44 and 45 through support plate 20 and, at these positions, causes projection 17 of sleeve 16 to be engaged by engagement claw 23 to prevent the drive force from being transmitted to eccentric cam 11. Also, as shown in FIG. 6, roller shaft shifting mechanism 30 engages sleeve 35 by means of engagement claw 39 at a position in which driven-side paper discharging roller shaft 3 is brought close to drive-side paper discharging roller shaft 1, thereby holding driven-side paper discharging roller shaft 3 in such a manner that shaft 3 is prevented from rotating.

Therefore, if recording paper S is discharged from fixing roller 48 while shafts 1 and 3 are orientated as such, then recording paper S is drawn by the upper and lower paper discharging rollers 2 and 4 and is discharged onto the paper discharging tray 47 in the normal manner.

However, if recording paper S' is to be sorted, that is, the recording paper S' has printed thereon information from a second personal computer, for example, then a control circuit 90 (shown schematically in FIG. 1) excites roller shaft shifting solenoid 38 at a time a (see FIG. 7) when a sorting signal is detected. Engagement claw 39 separates from projection 37 of sleeve 36 for a time sufficient to permit projection 37 to pass thereby, and driven-side paper discharging roller shaft 3 is rotated 180° by means of spring clutch 35 to separate paper discharging rollers 2 and 4 from each other. Further rotation is prevented by the engagement of engagement claw 39 with the other projection 37. As further illustrated in FIG. 7, roller shaft angling solenoid 22 is excited and causes the disengagement of engagement claw 23 from projection 17 of sleeve 16 also for a time sufficient to permit projection 17 to pass thereby, and eccentric cam 11 is rotated 180° by means of spring clutch 14 to move shaft support plate 20 and the shaft ends of the pair of paper discharging roller shafts 1 and 3 respectively journaled on shaft support plate 20, in the direction as shown by Arrow A in FIG. 5(*b*). Therefore, shafts 1 and 3 shift in the paper discharging direction to an angled position until displacement is stopped by the engagement of claw 23 and the next projection 17.

In this way, recording paper S' discharged out through fixing roller 48 is allowed to pass between paper discharging rollers 2 and 4 and a front half section of paper S' is then discharged out onto the paper discharging tray 47.

Thereafter, when the rear end of the recording paper S' is detected by a paper rear end detect sensor 49 at a time b (see FIG. 7), then the control circuit 90 on receipt of the detect signal, again excites the roller shaft shifting solenoid 38 for the time required to remove the engagement by engagement claw 39 to thereby transmit the rotational drive force to driven-side paper discharging roller shaft 3. Shaft 3 is then rotated 180° to bring upper and lower paper discharging rollers 2 and 4 into contact with each other again.

As a result, the angled paper discharging roller shafts 1 and 3 hold a rear half section of the recording paper S' between them and discharges paper S' in an oblique manner while it is still oriented in the paper discharging direction. In other words, shafts 1 and 3, as shown by the dotted lines in FIG. 2, place recording paper S' on recording paper S previously discharged so that recording paper S' is shifted relative to and disposed parallel to recording paper S, so that the two sets of recording paper, S and S', can be sorted and separated from each other easily.

Figure 7:
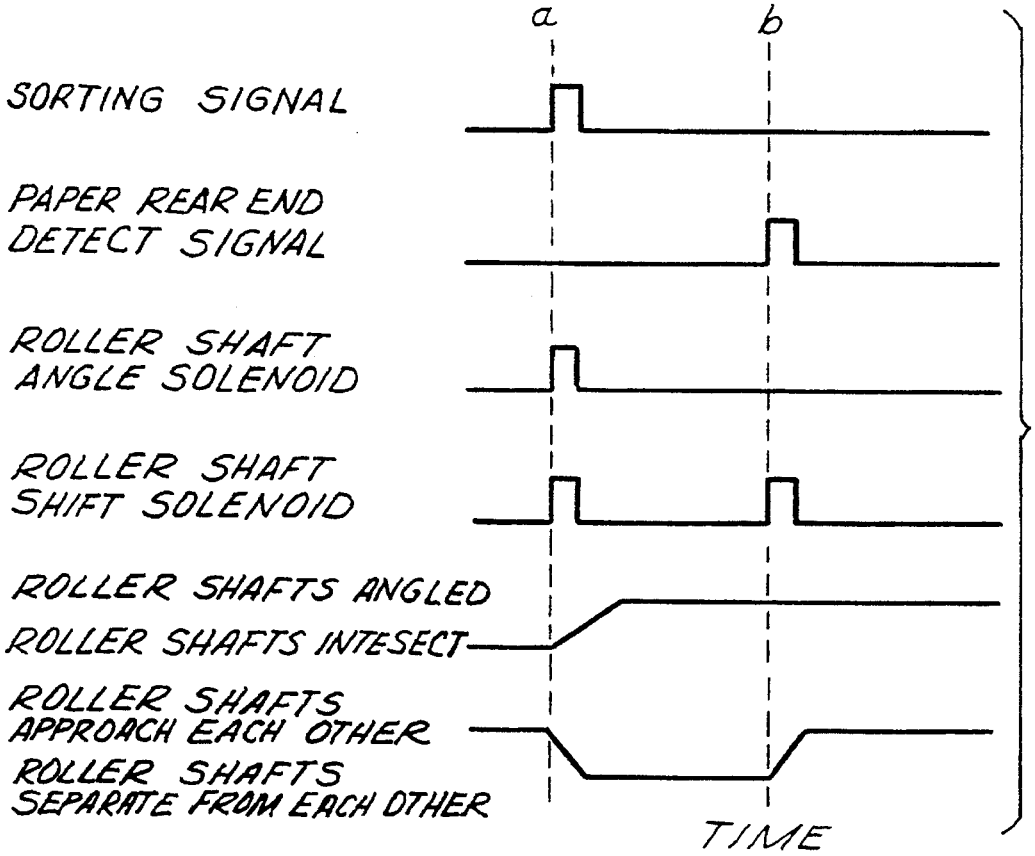
FIG. 7 is a timing chart showing the operation timing of the invention in accordance with the first embodiment.

As has been described above, according to this first embodiment, and as illustrated in FIG. 7, on receipt of a sorting signal the pair of paper discharging roller shafts 1 and 3 shift to an angled position with respect to the paper discharging direction, the two paper discharging rollers then separate from each other, the front half section of the recording paper is fed between rollers 2 and 4, and then the two paper discharging rollers 2 and 4 are pushed against each other to discharge out the rear half section of the recording paper. In this way, the recording paper to be sorted and separated from the previously discharged paper can be discharged in an oblique and parallel manner while it is oriented in the discharging direction, so that the paper can be accurately sorted from the other recording paper. Also, even in a step of taking out the paper from paper discharging tray 47, the mixing of the sorted recording paper with other sorted recording paper can be prevented as much as possible.

Figure 8:
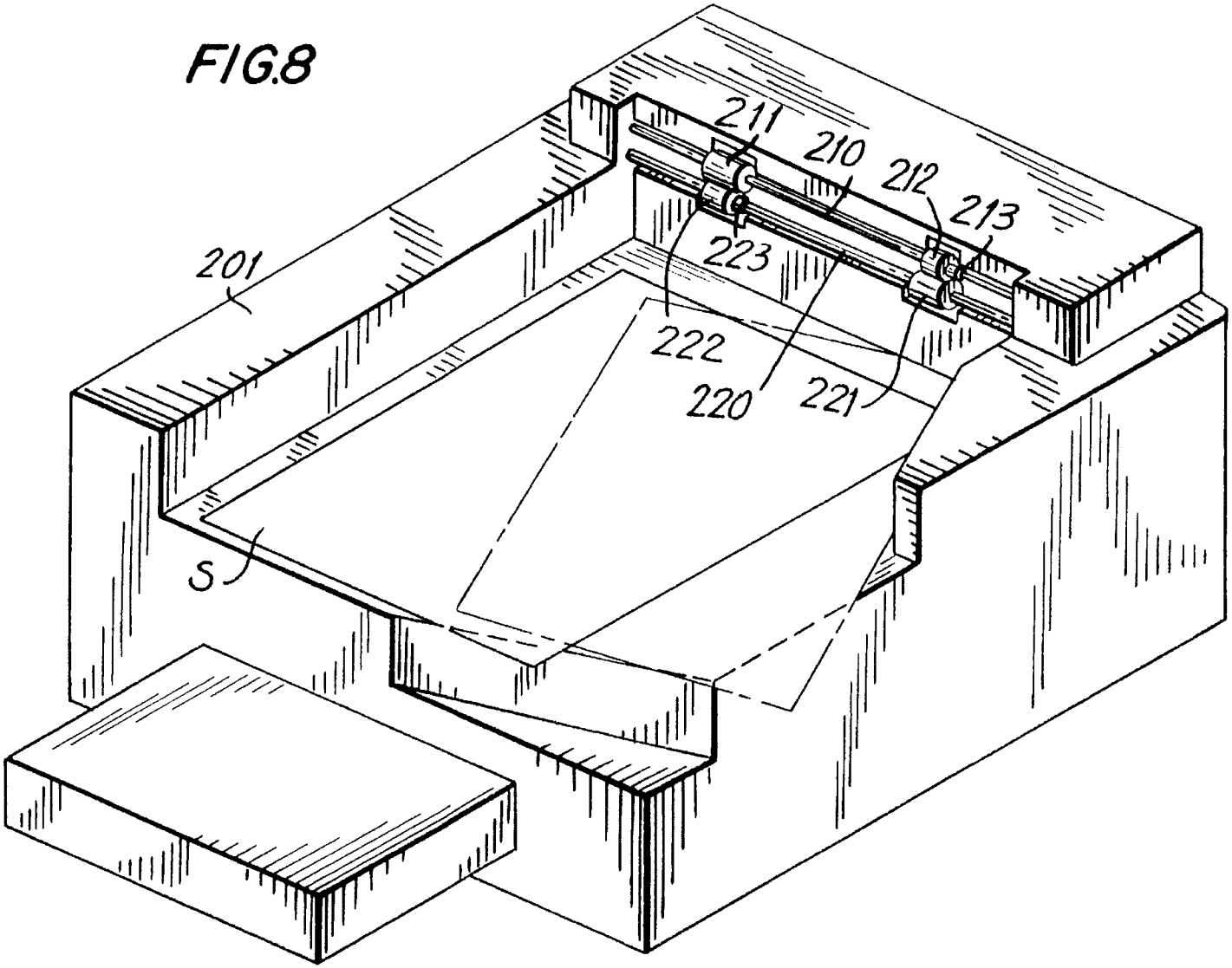
FIG. 8 is a perspective view of a recording paper sorting and discharging device in accordance with a second embodiment of the present invention.
Figure 9:
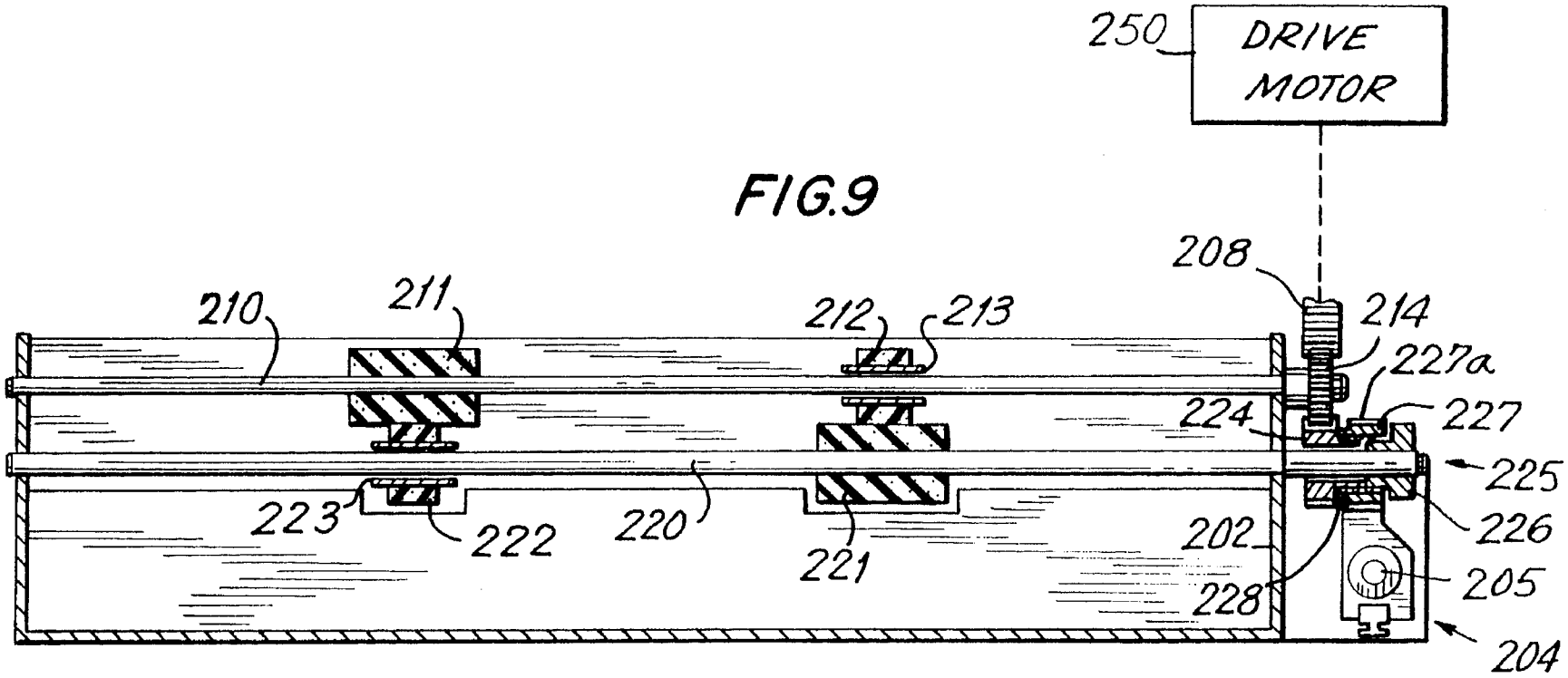
FIG. 9 is a cross-sectional view of a second embodiment of the present invention.
Figure 10:
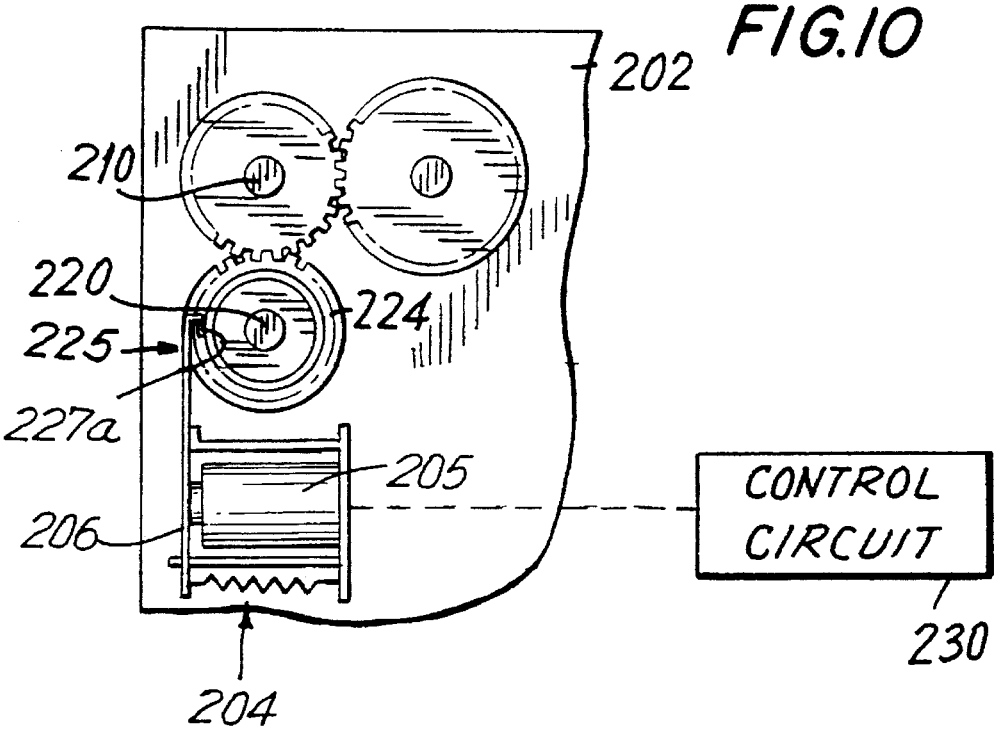
FIG. 10 is a right side elevational view of the drive mechanism in accordance with the second embodiment.

In accordance with a second embodiment of the present invention, reference is made to FIGS. 8–10, which depict a pair of paper discharging roller shafts 210 and 220 respectively mounted to the paper discharging section of a printer main body 201. As shown in FIG. 9, drive paper discharging rollers 211 and 221 are fixed to roller shafts 210 and 220, respectively. Driven paper discharging rollers 212 and 222 are rotatably mounted on roller shafts 210 and 220 through sleeves 213 and 223, respectively. Furthermore, rollers 211, 212, 221 and 222 are positioned on discharging roller shafts 210 and 220 in an alternately opposing manner, so that driven paper discharging roller 222 can contact drive paper discharging roller 211 and driven paper discharging roller 212 can contact drive paper discharging roller 221.

FIG. 9 depicts a drive force transmission gear 208 connected to a drive motor 250 (shown schematically in FIG. 9), and a pinion 214 fixed to one end of paper discharging roller shaft 210 and meshing with gear 208. Also, another pinion 224 is rotatably mounted to one end of paper discharging roller shaft 220 through a spring clutch, generally indicated at 225. Pinion 224 meshes with pinion 214. If the two paper discharging roller shafts 210 and 220 are both rotated by a switching mechanism 204 (which will be described later), then the recording paper S is discharged in a direction perpendicular to shafts 210 and 220. However, if only paper discharging roller shaft 210 is rotated, then the recording paper S can be discharged at an angle with drive discharging roller 221 on the stopped paper discharging roller shaft 220 acting as a fulcrum.

As more clearly illustrated in FIG. 10, a switching mechanism generally indicated at 204 includes a solenoid 205, mounted to a frame 202 of printer main body 201, situated adjacent to a spring clutch, generally indicated at 225, and an engagement claw 206 that is attracted and operated by solenoid 205. A coil spring 228 (FIG. 9) is wound round the respective boss portions of a bushing 226 and a pinion 224 coupling sleeve 224 and bushing 226. Bushing 226 is fixed to the end of the paper discharging roller shaft 220. If engagement claw 206 is engaged with a tooth 227*a* formed on the peripheral surface of a sleeve 227 to thereby prevent the rotational movement of sleeve 227, then a drive force from the pinion 224 is prevented from being transmitted to the bushing 226.

Next, description will be given below of the operation of the present device in accordance with the second embodiment.

When the recording paper S is discharged in a normal state, that is, when the recording paper S is discharged in a direction perpendicular to paper discharging roller shafts 210 and 220, solenoid 205, in its excited state, attracts engagement claw 206 to remove the engagement with sleeve 227.

As a result, coil spring 228 tightens the respective boss portions of bushing 226 and pinion 224 to transmit the drive force of pinion 224 to paper discharging roller shaft 220 and thus rotate paper discharging roller shaft 220 together with paper discharging roller shaft 210 disposed above shaft 220, so that the recording paper S is discharged straight onto a paper discharging tray 203 by drive paper discharging rollers 211 and 221 respectively fixed to their shafts 210 and 220 and by driven paper discharging rollers 212 and 222. Both pairs of rollers 211 and 222, and 212 and 221 apply pressure against each other as well as against paper S.

On the other hand, if recording paper S' is to be sorted, that is, recording paper S' has printed thereon information from a second personal computer, for example, then a solenoid drive circuit, on receipt of a detect signal from a paper detect sensor (not shown) and a sorting signal from the control circuit 230 (shown schematically in FIG. 10), deenergizes solenoid 205 to thereby bring engagement claw 206 into engagement with one of the teeth 227*a* on the peripheral surface of sleeve 227 (as shown in FIG. 10).

As a result, coil spring 228 removes the tightening force which is joining the respective boss portions of the bushing 226 and pinion 224, to thereby stop the rotational movement of the lower paper discharging roller shaft 220.

For this reason, paper discharging roller 212, which contacts drive paper discharging roller 221 fixed to shaft 220, also ceases any rotational movement. Therefore, while recording paper S' is discharging, it is discharged at an angle as shown by a two-dot chained line in FIG. 8 with paper discharging rollers 221 and 212 acting as the fulcrums thereof. Recording paper S' is therefore discharged onto paper discharging tray 203 at an angle relative to paper S and is clearly separated and sorted from the other recording paper S.

Figure 11:
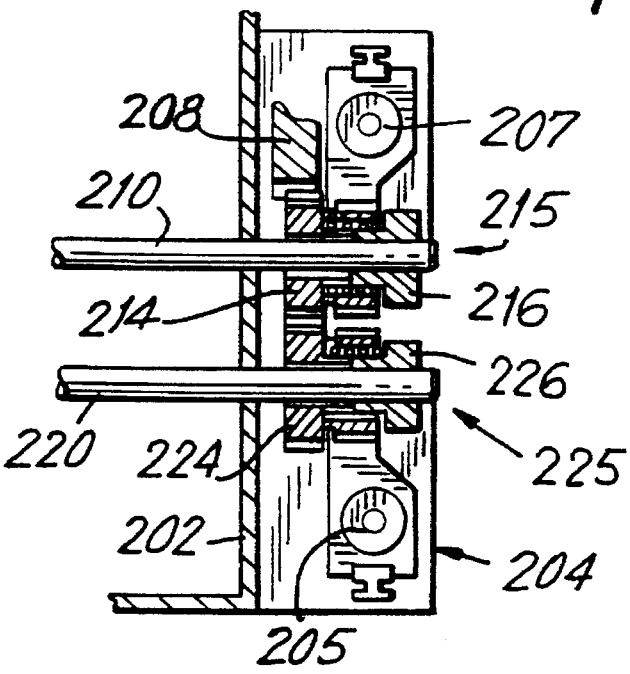
FIG. 11 is a partial crosssectional view of the drive mechanism in accordance with a third embodiment of the present invention.

In accordance with a third embodiment of the present invention, and as illustrated in FIG. 11, recording paper S can be sorted in three ways by discharging it straight or by discharging it at various angles with respect to a straight discharge path.

The sorting and discharging device, in accordance with the third embodiment, is constructed and arranged such that two pinions 214 and 224 mesh with each other and are rotatably mounted on paper discharging roller shafts 210 and 220, respectively. Bushings 216 and 226 are respectively fixed to the end portions of paper discharging roller shafts 210 and 229. Shafts 210 and 220 are connected with pinions 214 and 224 through spring clutches 215 and 225, respectively. Furthermore, spring clutches 215 and 225 can be operated independently of each other by switching mechanisms 204 and 207 provided on a frame 202, respectively.

Therefore, if the two spring clutches 215 and 225 are actuated, then the recording paper S can be discharged out straight. Also, if the drive force of one of the two paper discharging roller shafts 210 and 220 is cut off by means of the switching mechanisms 204 or 207, then recording paper S can be discharged at an angle relative to discharged sheets S, with the drive paper discharging roller on the stopped shaft and the driven roller opposite thereto acting as the fulcrums thereof, so that recording paper S' can be distinguished from the other recording paper S.

As has been described above, according to the present embodiment, the pair of paper discharging roller shafts with the drive paper discharging roller fixed to one side of the shaft and the driven paper discharging roller mounted rotatably to the other side thereof are alternately disposed, such that the drive and driven rollers can contact each other, and at least one of the paper discharging roller shafts is structured such that it can be freely separated from the drive system. Therefore, in the normal paper discharging step, the recording paper can be discharged out straight while the two paper discharging roller shafts are being driven and, in the discharging and sorting step, by separating one of the paper discharging roller shafts from the drive system, the corresponding paper discharging roller can be stopped without producing friction between the other corresponding roller and itself, so that the recording paper can be discharged and thereby sorted at an angle while it is smoothly discharged without any wrinkles or the like being formed on the recording paper.

Also, in accordance with the first embodiment of the invention, the recording paper is sorted by moving it simultaneously parallel and perpendicular to the standard paper discharging direction, which makes it necessary to increase the width of the paper discharging tray to an extent equal to the parallel displacement of paper S'. On the other hand, in the sorting and discharging device according to the second or third embodiment of the present invention, the recording paper is sorted merely by rotating the paper. Therefore, it is not always necessary to increase the width of the paper discharging tray, thus resulting in a reduced space for installation of the device.

FIGS. 12–16 illustrate a fourth embodiment of the present invention disclosing an alternate way in which the recording paper is discharged.

Figure 12:
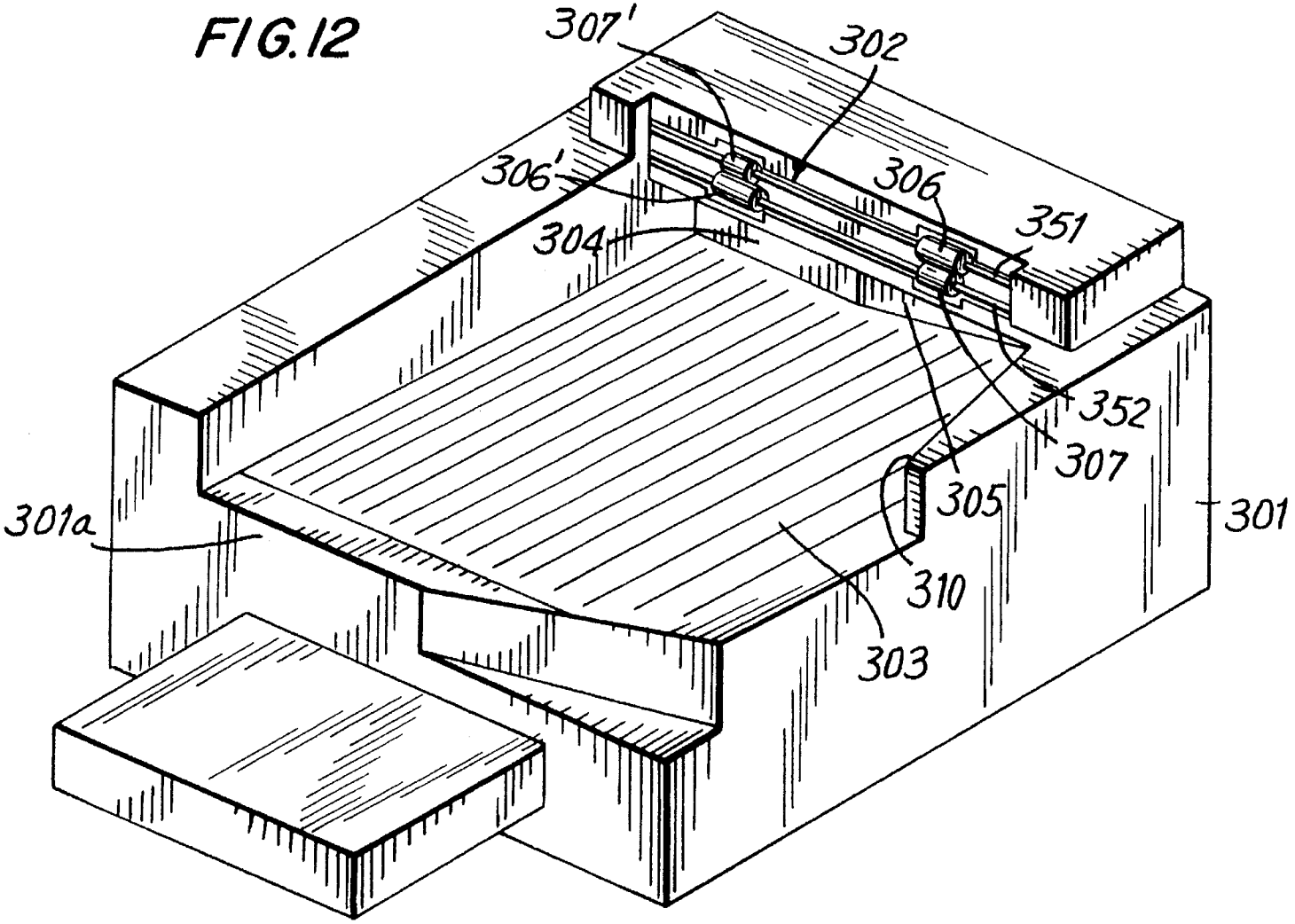
FIG. 12 is a perspective view of a recording paper sorting and discharging device in accordance with a fourth embodiment of the present invention.

FIG. 12 shows a printer main body 301 and a discharge section generally indicated at 302, which has a similar structure to the discharge construction of the second embodiment. That is, FIG. 12 depicts a pair of paper discharging roller shafts 351 and 352, drive paper discharging rollers 306 and 306' affixed to paper discharging roller shafts 351 and 352, respectively, and driven paper discharging rollers 307' and 307 which are rotatably mounted on paper discharging roller shafts 351 and 352, respectively. Further, drive paper discharging rollers 306 and 306' contact driven paper discharging rollers 307 and 307', respectively.

Therefore, discharge section 302 is able to discharge recording paper S and S' in a straight condition or at an angled position.

A paper discharging tray 303 forms a receiving area for receiving the recording paper discharged out from discharge section 302.

Paper discharging tray 303 provides an inclined surface which descends toward discharge section 302 from the front 301a of main body 301, so that the recording paper discharged can be stacked sequentially.

Figure 13:
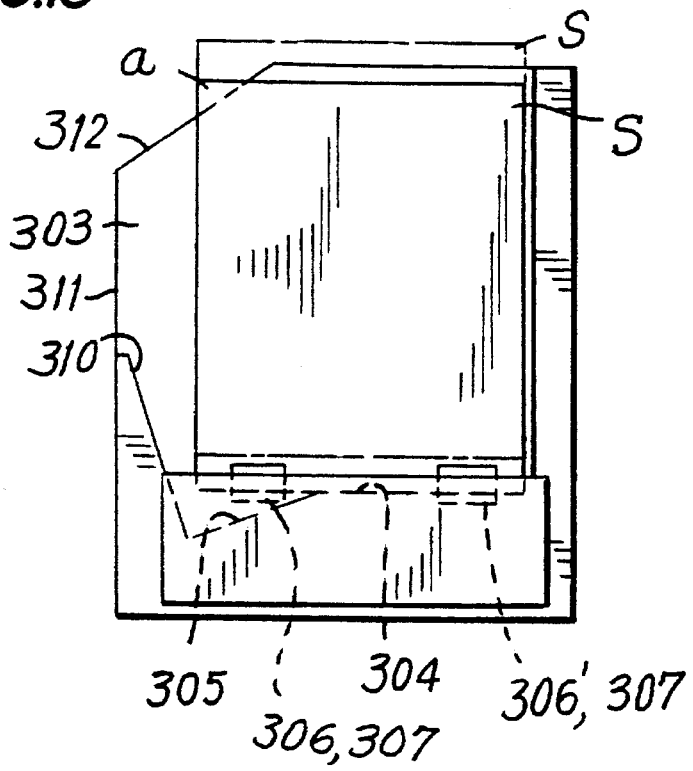
FIG. 13 is a top plan view of the device in accordance with the fourth embodiment, illustrating the paper discharging states thereof.

The rear end portion of paper discharging tray 303 is composed of an angled surface 305 and a surface 304 extending in a direction perpendicular to the paper discharging direction. Surface 304 and angled surface 305 are located behind an imaginary plane created by shafts 351 and 352. This arrangement allows the recording paper discharged, whether discharged out straight or at an angle from discharge section 302, to move backward on the tray essentially simultaneously when it drops down, thereby contacting surface 304 or angled surface 305 for support. In this manner, the recording paper can be stacked neatly. FIG. 13 shows the recording paper in dotted lines, just before it drops down and moves backward to contact either surface 304 or 305.

Further, FIG. 13 illustrates the front end portion of paper discharging tray 303, which is provided with a cutaway edge portion 312 which is cut away in part. The front end corner portion a of recording paper S discharged out straight is projected out from cutaway edge portion 312.

Figure 14:
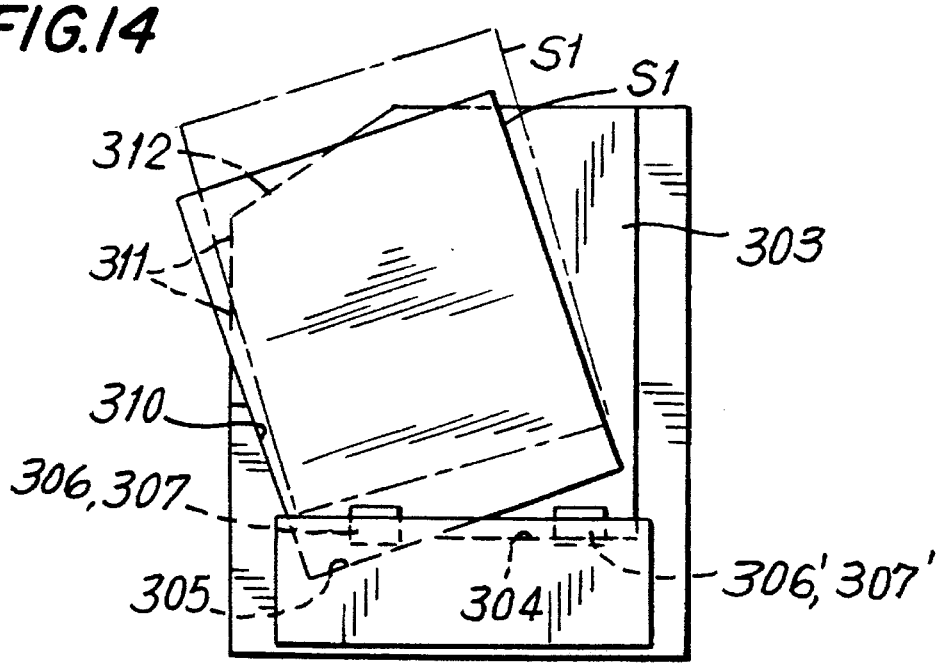
FIG. 14 is a top plan view of the device in accordance with the fourth embodiment, illustrating the paper discharging states thereof.

As illustrated in FIG. 14, the paper discharging tray part 303 includes on one side thereof a paper receive surface 310 at right angles to the above-mentioned angled surface 305. In this configuration, recording paper S1 discharged out obliquely from discharge section 302 can slide and move obliquely and backwardly on paper discharging tray 303, and thereafter be supported by surfaces 305 and 310.

As further shown in FIG. 14, paper receive surface 310 terminates in the portion thereof which intersects the side edge of paper discharging tray 303. This allows recording paper S1 that is discharged obliquely and stacked to extend out from a front edge portion 311 of the paper discharging tray 303. Recording paper S1 is also in part supported by receive surface 310. The recording paper, just before it drops down, is shown by a dotted line in FIG. 14.

According to the sorting and discharging device constructed in accordance with this fourth embodiment, in a normal printing operation, recording paper S is discharged out straight onto paper discharging tray 303 and, when the thus discharged recording paper S can be removed by grasping corner portion a thereof which projects out from cutaway edge portion 312 of paper discharging tray 303 (see FIG. 13).

Figure 15:
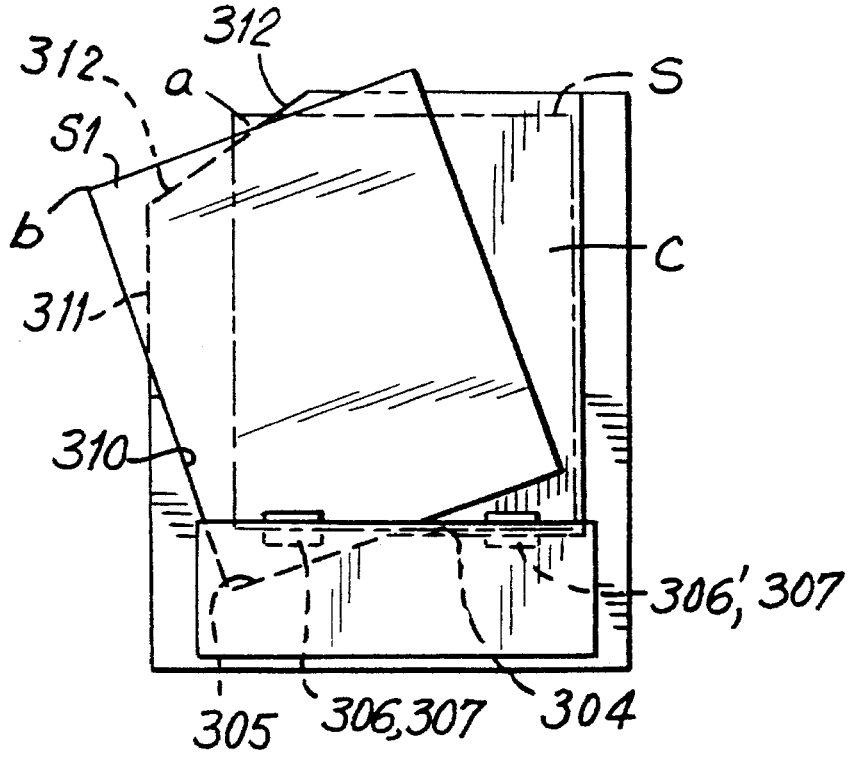
FIG. 15 is a top plan view of the device in accordance with the fourth embodiment, illustrating the paper discharging states thereof.

On the other hand, when two or more personal computers, by way of example, are connected to the printer by means of a network or the like, and the printer is used in common with these computers, the recording paper can be discharged straight out of discharge section 303 or at an angle with respect to shafts 351 and 352. In this situation, and as shown in FIG. 15, the corner portion a of recording paper S discharged straight projects out from cutaway edge portion 312 and the corner portion b of recording paper S1 which was discharged obliquely projects out from side edge portion 311. Therefore, if projecting corner portion a of recording paper S or projecting corner portion b of recording paper S1 is grasped by one's fingers, and either corner portion a or corner portion b is pulled forward, then the recording paper desired to be removed can be taken out without any scattering of recording paper taking place.

Also, as an alternative method of taking out the recording paper S1 discharged obliquely, there is available a method in which corner portion b of recording paper S1 is grasped and pulled out while holding a portion c of a recording paper S2 in which there are not at least two or more sheets of recording paper S1 separated by at least one sheet of paper S or paper S2 therebetween.

Figure 16:
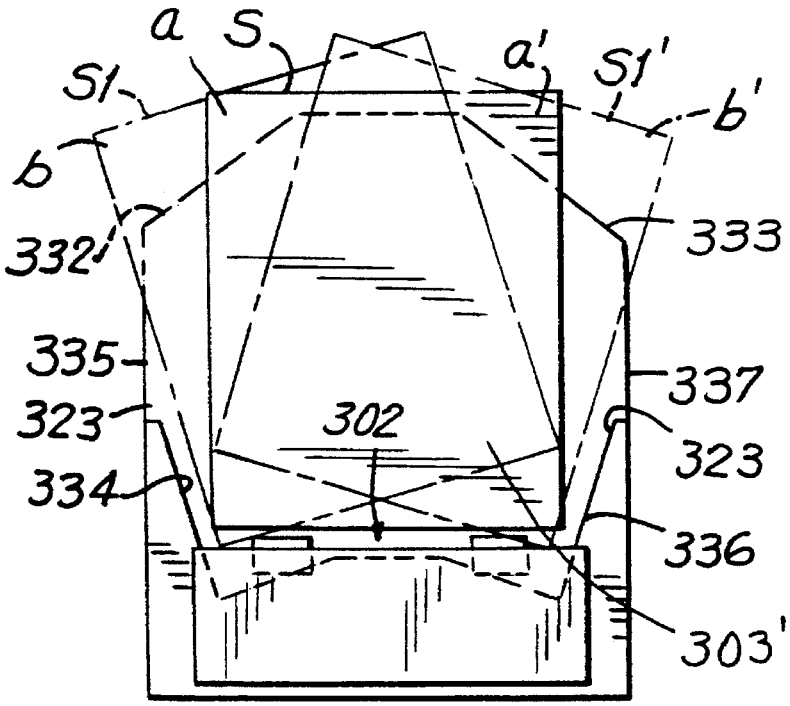
FIG. 16 is a top plan view of a modification of the paper discharging tray in accordance with the fourth embodiment of the present invention.

FIG. 16 discloses a modification to the construction of printer main body 301. There are cutaway edge portions 332 and 333 on the two sides of the front edge of a paper discharging tray 323. Two corner portions a and a' of recording paper S are respectively projected out from cutaway edge portions 332 and 333. Paper receive surfaces 334 and 336 are respectively provided on the two sides of the paper discharging tray part 323, and corner portions b and b' of the recording paper S1 and S1', respectively, are projected out from the right and left front side edge portions 335 and 337 respectively disposed in front of the paper receive surfaces 334 and 336. Recording paper S discharged straight, and recording paper S1 and S1' discharged at an angle thereby extending out from side edge portions 335 or 337, can be removed by grasping the projecting portions, a, a', b, b' thereof, respectively. Furthermore, the construction and arrangement of a discharge section as there is employed in this fourth embodiment is similar in construction to that of discharge section 302 of the abovementioned third embodiment (see FIG. 11). But, it is understood that the construction of the tray in this fourth embodiment could work equally as well with the discharge section in the second embodiment.

As has been described heretofore, according to the fourth embodiment, paper discharging tray 323 of the printer includes cutaway sections which allow the recording paper to be discharged out in at least two directions. There is a cutaway portion over which the front end portion of the recording paper projects, and a side edge portion over which the front end corner portion of recording paper S1 or S1' projects. Therefore, by grasping the portions projecting out over these cutaway portions and pulling out the recording paper desired, the recording paper desired to be removed can be removed easily because it is neatly stacked and furthermore there is no fear of scattering the remaining sheets of recording paper remaining on the tray 323.

It is to be understood that in the foregoing embodiments, disclosure has been given by way of example in which the present invention is adapted to a printer. Therefore, it is further understood that the invention disclosed herein can also be adapted to a copying machine or the like.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A recording paper sorting and discharging device for sorting and discharging a recording paper, comprising:

a discharge section for discharging a recording paper in at least one of a direction orthogonal to said discharge section and at an angle with respect to said discharge section, comprising:

a first discharging roller shaft rotatably supported in said discharge section;

a second discharging roller shaft rotatably supported in said discharge section in spaced relation to said first discharging roller shaft;

a first drive roller fixed to said first discharging roller shaft;

a first driven roller rotatably mounted to said second discharging roller shaft, said first driven roller engaging and rotating with said first drive roller;

a second driven roller rotatably mounted to said first discharging roller shaft a second drive roller fixed to said second discharging roller shaft, said second drive roller engaging and rotating with said second driven roller;

a drive mechanism for rotating said first and second discharging roller shafts; and a switching mechanism for selectively cutting off said rotation of at least one of said first and second discharge roller shafts;

a paper discharging tray for receiving a recording paper discharged out from said discharge section, said paper discharging tray including:

a first edge portion over which a section of a recording paper discharged in said orthogonal direction is projected; and a second edge portion over which a section of a recording paper discharged at an angle with respect to said orthogonal discharge direction is projected.

2. The recording paper sorting and discharging device claimed in claim 1, wherein a plane of said first edge portion forms an angle with respect to a plane of an edge of a recording paper discharged in said orthogonal direction.

3. The recording paper sorting and discharging device claimed in claim 1, wherein a plane of said second edge portion is at least essentially parallel to a side edge of a recording paper discharged in said orthogonal direction.

4. The recording paper sorting and discharging device claimed in claim 3, wherein a plane of said second edge portion forms an angle with respect to a plane of an edge of a recording paper discharged at an angle with respect to said orthogonal direction.

5. The recording paper sorting and discharging device claimed in claim 1, wherein said paper discharging tray is inclined toward said edge portions.

6. The recording paper sorting and discharging device claimed in claim 5, wherein said paper discharging tray includes a first support surface for supporting a rear end edge of a recording paper discharged orthogonal to said discharge section..

7. The recording paper sorting and discharging device claimed in claim 6, wherein said paper discharging tray includes a second support surface for supporting a rear end edge of a recording paper discharged at an angle with respect to said discharge section and a third support surface for supporting a side edge of a recording paper discharged at said angle.

8. The recording paper sorting and discharging device claimed in claim 7, and including a secondary second support surface for supporting a rear end edge of a recording paper discharged at a second angle with respect to said discharge section and a secondary third support surface for supporting a side edge of a recording paper discharged at said second angle, and wherein said second and third support surfaces are formed on a first side of said device and said secondary second support surface and said secondary third support surface are formed on a second side of said device.

9. The recording paper sorting and discharging device as claimed in claim 6, wherein said first support surface is located behind a plane formed by said first and second discharging roller shafts.

10. The recording paper sorting and discharging device as claimed in claim 7, wherein said second support surface is located behind a plane formed by said first and second discharging roller shafts.

11. The recording paper sorting and discharging device claimed in claim 1, and including a secondary first edge portion over which a section of a recording paper discharged in said orthogonal direction is projected and a secondary second edge portion over which a section of a recording paper discharged at a second angle with respect to said orthogonal discharge direction is projected, and wherein said first and second edge portions are on a first side of said device and said secondary first edge portion and said secondary second edge portion are formed on a second side of said device.

12. The recording paper sorting and discharging device claimed in claim 11, wherein a plane of said secondary first edge portion forms an angle with respect to a plane of an edge of a recording paper discharged in said orthogonal direction and wherein a plane of said secondary second edge portion is at least essentially parallel to a side edge of a recording paper discharged in said orthogonal direction.

13. The recording paper sorting and discharging device claimed in claim 11, wherein a plane of said secondary second edge portion forms an angle with respect to a plane of an edge of a recording paper discharged at said second angle.

14. The recording paper sorting and discharging device claimed in claim 1, wherein said paper discharging tray includes a second support surface for supporting a rear end edge of a recording paper discharged at an angle with respect to said discharge section and a third support surface for supporting a side edge of a recording paper discharged at said angle.

15. The recording paper sorting and discharging device claimed in claim 1, and including a secondary second support surface for supporting a rear end edge of a recording paper discharged at a second angle with respect to said discharge section and a secondary third support surface for supporting a side edge of a recording paper discharged at said second angle, and wherein said second and third support surfaces are formed on a first side of said device and said secondary second support surface and said secondary third support surface are formed on a second side of said device.

* * * * *